US009272175B2

(12) United States Patent
Egan

(10) Patent No.: US 9,272,175 B2
(45) Date of Patent: Mar. 1, 2016

(54) EXERCISE DEVICE

(76) Inventor: Fiona Mary Egan, Roscommon (IE)

( * ) Notice: Subject to any disclaimer, the term of this patent is extended or adjusted under 35 U.S.C. 154(b) by 123 days.

(21) Appl. No.: 14/124,549

(22) PCT Filed: Jun. 8, 2012

(86) PCT No.: PCT/EP2012/060935

§ 371 (c)(1),
(2), (4) Date: Dec. 6, 2013

(87) PCT Pub. No.: WO2012/168455

PCT Pub. Date: Dec. 13, 2012

(65) Prior Publication Data

US 2014/0113775 A1 Apr. 24, 2014

(30) Foreign Application Priority Data

Jun. 8, 2011 (GB) ..... 1109574.2

(51) Int. Cl.
*A63B 21/00* (2006.01)
*A63B 22/06* (2006.01)
(Continued)

(52) U.S. Cl.
CPC ..... *A63B 21/00181* (2013.01); *A63B 22/02* (2013.01); *A63B 22/06* (2013.01);
(Continued)

(58) Field of Classification Search
CPC ..... A63B 21/00149; A63B 21/00152; A63B 21/00181; A63B 21/1403; A63B 21/1415; A63B 21/1419; A63B 21/1476; A63B 22/0046; A63B 22/02; A63B 22/04; A63B 22/06; A63B 2022/0094; A63B 2022/0097; A63B 23/02; A63B 23/0205; A63B 23/0216; A63B 23/0222; A63B 23/0244; A63B 23/035; A63B 23/03516; A63B 23/0325; A63B 23/04; A63B 23/18; A63B 2071/009; A63B 2208/02; A63B 2208/0204; A63B 2208/05; A63B 2208/053; A63B 2208/056; A63B 2210/50; A63B 2220/70; A63B 2220/74; A63B 71/0619
See application file for complete search history.

(56) References Cited

U.S. PATENT DOCUMENTS 44,198 A * 9/1864 Jones ..... 601/11
54,530 A * 5/1866 Hadfield ..... 601/11
(Continued)

FOREIGN PATENT DOCUMENTS

DE 10316009 A1 * 11/2004 ..... A63B 23/035
DE 102004031548 A1 * 2/2006 ..... A63B 21/00
(Continued)

OTHER PUBLICATIONS

International Search Report for International Application No. PCT/EP2012/060935 mailed Oct. 17, 2012.
(Continued)

*Primary Examiner* — Oren Ginsberg
*Assistant Examiner* — Gary D Urbiel Goldner
(74) *Attorney, Agent, or Firm* — Brian J. Colandreo; Michael T. Abramson; Holland & Knight LLP

(57) ABSTRACT

This invention relates to an exercise device (1) and more particularly to an exercise device of the type that allows the user of the exercise device to exercise with part of their body in a negative pressure environment. These devices are becoming increasingly popular however the known devices are usually bulky, difficult to transport, difficult to install and difficult to maintain. The present invention provides a construction of exercise device that will enable the device to be transported and installed in a more efficient manner by providing the casing (3), in particular, in a number or pieces (21, 23) that can be connected together easily and quickly on site. The casing will still be sufficiently air tight. Furthermore, the construction of the present invention permits easier access to the interior of the casing (3) for cleaning/servicing purposes thereby simplifying cleaning and repair significantly.

19 Claims, 22 Drawing Sheets

(51) Int. Cl.

| | |
|---|---|
| ***A63B 23/02*** | (2006.01) |
| ***A63B 22/02*** | (2006.01) |
| ***A63B 23/04*** | (2006.01) |
| *A63B 71/06* | (2006.01) |

(52) U.S. Cl.

CPC ..... *A63B 23/02* (2013.01); *A63B 23/04* (2013.01); *A63B 71/0619* (2013.01); *A63B 2208/056* (2013.01); *A63B 2210/50* (2013.01)

(56) References Cited

U.S. PATENT DOCUMENTS

| | | | | | |
|---|---|---|---|---|---|
| 60,883 | A | * | 1/1867 | Hadfield | 601/11 |
| 72,631 | A | * | 12/1867 | Hadfield | 601/11 |
| 100,867 | A | * | 3/1870 | Curran | 601/11 |
| 871,074 | A | * | 11/1907 | Stockton | 601/11 |
| 1,336,774 | A | | 4/1920 | Cooper | |
| 5,133,339 | A | | 7/1992 | Whalen et al. | |
| 5,356,361 | A | * | 10/1994 | Watenpaugh | 482/111 |
| 2002/0025889 | A1 | | 2/2002 | Egger | |
| 2007/0054783 | A1 | | 3/2007 | Egger | |
| 2007/0181121 | A1 | * | 8/2007 | Whalen et al. | 128/202.12 |
| 2008/0132813 | A1 | * | 6/2008 | Katsuta | 601/49 |
| 2012/0238921 | A1 | * | 9/2012 | Kuehne et al. | 601/5 |

FOREIGN PATENT DOCUMENTS

| | | | |
|---|---|---|---|
| JP | 2007044194 | A | 2/2007 |
| WO | 2004047710 | A1 | 6/2004 |
| WO | 2009/051750 | A1 | 4/2009 |
| WO | 2009/051765 | A1 | 4/2009 |
| WO | 2010132550 | A1 | 11/2010 |

OTHER PUBLICATIONS

International Preliminary Report on Patentability for International Application No. PCT/EP2012/060935 mailed Dec. 27, 2013. 7 pages.

* cited by examiner

EXERCISE DEVICE

RELATED APPLICATIONS

The subject application is a U.S. National Stage application of International Application No. PCT/EP2012/060935, which claims the priority of United Kingdom National Application No.: 1109574.2, filed on 8 Jun. 2011, the contents of which are herein incorporated by reference in its entirety.

INTRODUCTION

This invention relates to an exercise device and more particularly to an exercise device of the type that allows the user of the exercise device to exercise with part of their body in a negative pressure environment.

Exercise devices that allow the user of the exercise device to exercise with part of their body in a negative pressure environment have become increasingly popular. It has been found that by exercising with part of their body in a negative pressure environment, for example that part of their body below the torso, the quality and intensity of the workout can be improved significantly. This leads to a reduction in the amount of time required to exercise for the same amount of physical health benefit or alternatively will result in an increased physical health benefit obtained from the exercise if the workout time is not reduced. Various other health benefits have been observed including but not limited to a reduction in cellulite and an improvement in the appearance of varicose veins.

There are numerous exercise devices that allow the user of the exercise device to exercise with part of their body in a negative pressure environment available on the market today. PCT Patent Publication Nos. WO2009/051750 and WO2009/051765, both in the name of Alterg Inc., describe various embodiments of exercise devices that allow the user of the exercise device to exercise with part of their body in a negative pressure environment. U.S. Pat. No. 5,133,339 in the name of Whalen et al and Polish utility models PL64980Y1, PL64905Y1 and PL64906Y1, all in the name of VacuFit Sp. z o. o., show various embodiments of exercise devices that allow the user of the exercise device to exercise with part of their body in a negative pressure environment.

As of the filing date of the present application, other similar exercise devices were available through the companies Body Space (Registered Trade Mark,®) (www.spacesun.eu), Vacuwell® (www.vacuwell.com), Vacustep® (www.vacustep.com) and Vacuspace® (www.vacuspace.pl).

Although there are numerous benefits to this type of exercise device, there are problems with the known exercise devices. First of all, fundamental to the operation of the exercise device is the ability to maintain a negative pressure within the chamber. Accordingly, the design of outer casing is particularly important in order to minimise leaks from the chamber. To that end, the devices currently available on the market are provided with a unitary moulded casing construction. Although this configuration minimises leaks from the casing, it results in a very large, cumbersome exercise device that is problematic to ship and deliver.

It is not uncommon for the known devices to be too large to be brought in through the door of the premises to which the exercise device is being delivered and often a window must be temporarily removed in order to install the exercise device in a premises. Furthermore, the bulky nature of the exercise device limits the locations that the exercise devices may be installed and typically it is not possible to install the exercise devices on an upper or below-ground floor of a premises as the exercise device is too bulky to navigate the stairs with.

Secondly, the known exercise devices are notoriously difficult and time consuming to clean. It is not uncommon for users of the exercise devices to sweat profusely during use of the exercise device and in order to provide a sanitary exercise device and indeed in order to optimise the users experience, it is desirable to clean the exercise device regularly. Furthermore, due to the fact that the exercise device has a sealed chamber, lint build-up can become a significant problem and can pose a fire hazard if not removed through regular cleaning. This represents a significant problem for the operator of the exercise device.

Various devices have been devised that have multi-component casings. For example, US2007/0054783, in the name of Egger, describes an exercise device that has a front part and a rear part that may be splayed apart from each other to facilitate entry to and exit from the chamber. It is believed that this configuration may facilitate cleaning of the interior of the device however it is also believed that such a construction could not be constructed on site in a simple manner and indeed the construction is not intended or entirely suitable for such a purpose. Indeed this construction may be seen as a casing with an enlarged door to the chamber. US2002/0025889, also in the name of Egger, describes an apparatus for physical training that comprises a top part and bottom part that may be splayed apart from each other also to facilitate entry to and exit from the chamber. The top part and bottom part may be provided separately to facilitate transport of the apparatus. Although this configuration goes some way to solving some of the problems of the prior art devices, it is believed that the two parts of the shell will still be relatively bulky in transit and the entire apparatus will take a substantial amount of time to construct. Furthermore, this construction may also be seen as a casing with an enlarged door to the chamber. WO2010/132550, in the name of Kuehne et al, describes a differential air pressure system that includes a collapsible chamber that it is claimed facilitates entry to and exit from the chamber. It is believed that the collapsible nature of the system will facilitate transportation of the system.

It is an object of the present invention to provide an exercise device of the type that allows the user of the exercise device to exercise with part of their body in a negative pressure environment that overcomes at least some of the above-mentioned problems. It is a further object of the present invention to provide an exercise device that offers the consumer a useful choice.

STATEMENTS OF INVENTION

According to the invention there is provided an exercise device comprising a casing defining an exercise chamber having an opening to receive the torso of an individual during use of the exercise device, a door in the casing to provide access to and from the exercise chamber, an exercise unit located in the exercise chamber, a vacuum pump operable to create a negative pressure in the exercise chamber and a control means for controlling the exercise unit and the vacuum pump, in which the exercise device is provided in a modular construction format having a plurality of separate components connectable together on site to form the exercise device, the components including at least a separate planar base plate suitable for reception of the exercise device thereon and in which, in addition to the door that provides access into the chamber, the casing comprises a two-part casing divided along the longitudinal axis of the casing and along a vertical plane into two substantially equally-dimensioned opposite parts including a left side casing panel and a right side casing panel, the left side casing panel and the right side casing panel each having complementary engagement members for engagement of the other of the left side casing panel and the right side casing panel, and in which there is provided a hinge joint mounted on the base for engagement of at least one of the left side casing panel and the right side casing panel and to permit pivoting of the connected left side casing panel and right side casing panels in unison about the hinge joint to and from a lowered position in which the left side casing panel and the right side casing panel are in sealed engagement with the base and a raised position in which the left side casing panel and the right side casing panel are inclined with respect to the base allowing access to the interior of the chamber between the left side casing panel, the right side casing panel and the base plate By having such a construction of exercise device, the exercise device may be easily transported to the premises of a customer and installed in the premises. Due to the fact that the exercise device is provided in a modular format, it will be possible to package the exercise device more compactly, ready for assembly on site. This will reduce shipping costs but more importantly will also allow more flexibility in the positioning of the exercise device as it will be possible to navigate stairs and narrow doorways with the exercise device packaged in such a compact form. Of particular benefit is the very simple construction of casing that may be constructed in a matter of minutes and that will still be able to provide a sufficiently sealed chamber for the vacuum.

Providing the exercise device in a modular construction is counterintuitive to the present acknowledged wisdom and practice in the field. This is due to the fact that a non-unitary enclosure is believed to be more likely to leak thereby preventing a sufficient negative pressure from being created in the chamber and/or placing additional stresses on the vacuum pump thereby causing maintenance problems. However, the simple construction according to the present invention overcomes these prejudices. By having the casing hingedly mounted on the base plate, the casing will be accurately positioned on the base plate thereby ensuring that a good seal is formed between the casing and the base plate, minimising air leakage into the chamber. Furthermore, as an additional benefit, by having the casing hingedly mounted on the base plate, the casing may be pivoted about the hinge to allow cleaning of the interior of the exercise device. This will significantly simplify and speed up the cleaning process as easy access to the interior of the exercise device is provided.

In one embodiment of the invention there is provided an exercise device in which there is provided a rubber seal intermediate the pair of casing panels and the base plate. A rubber seal is seen as the preferred seal to use as it is resiliently deformable and thereby will allow repeated opening and closing of the casing relative to the base plate about the hinge joint and will provide a good air tight seal each time the casing and base plate are brought into engagement with each other.

In one embodiment of the invention there is provided an exercise device in which the base plate comprises a peripheral lip having a channel formed therein for reception of the lowermost edge of both the left side casing panel and the right side casing panel. This is seen as particularly useful as this configuration will ensure that the casing panels and the base plate will together form a good engagement and hence a good seal each time they are brought into engagement with each other.

In one embodiment of the invention there is provided an exercise device in which there is provided a seal intermediate the left side casing panel and the right side casing panel.

In one embodiment of the invention there is provided an exercise device in which the seal intermediate the left side casing panel and the right side casing panel is a H-seal. A H-seal is a particularly preferred seal to use in this instance as it will be simple to install for a workman constructing the exercise device on his own and furthermore will provide a good reliable seal to the chamber.

In one embodiment of the invention there is provided an exercise device in which the seal intermediate the left side casing panel and the right side casing panel is provided with a plurality of apertures for reception of one set of the complementary engagement members on one of the left side casing panel and the right side casing panel.

In one embodiment of the invention there is provided an exercise device in which there is provided a separate horseshoe-shaped, opening-defining bracket for engagement of both the left side casing panel and the right side casing panel and partially surround the opening for the users torso. By having such a bracket, the two panel sections will be held in close engagement with each other and there will be less tendency for the two side casing panels to separate from each other.

In one embodiment of the invention there is provided an exercise device in which the door is provided with an arcuate-shaped, opening-defining bracket which together with the horseshoe-shaped, opening-defining bracket form an annular, opening-defining bracket for reception of a sealing skirt when the door is closed.

In one embodiment of the invention there is provided an exercise device in which there is provided a unitary handlebar frame that is dimensioned to span across and be connected to both the left side casing panel and the right side casing panel and act as a bracing strut therebetween. Again, by having such a construction of handlebar frame, the two side casing panels will be held in close engagement with respect to each other and will have less tendency to separate. The integrity of the negative pressure inside the chamber will therefore be enhanced.

In one embodiment of the invention there is provided an exercise device in which there is provided a unitary drinks tray that is dimensioned to span across and be connected to both the left side casing panel and the right side casing panel and act as a bracing strut therebetween.

In one embodiment of the invention there is provided an exercise device in which the separate enclosure for the electronics panel is dimensioned to span across and be connected to both the left side casing panel and the right side casing panel and act as a bracing strut therebetween.

In one embodiment of the invention there is provided an exercise device in which the plurality of components are releasably connectable together. By having the components releasably connectable together, it will be possible to disassemble the exercise device and move the exercise device to another location in the premises which is also highly desirable. To this end, the complementary engagement members will permit disengagement of the complementary engagement members.

In one embodiment of the invention there is provided an exercise device in which there is further provided a strut internal the casing to releasably maintain the casing in a raised position.

In one embodiment of the invention there is provided an exercise device in which the hinge joint is located adjacent the forwardmost point on the base plate and in which the hinge joint is connected to both the left side casing panel and the right side casing panel. By being connected to both the left side casing panel and the right side casing panel there will be less tendency for either of the casing panels to warp or become damaged as the forces exerted on both panels should be substantially equal. In one embodiment of the invention there is provided an exercise device in which the exercise unit is a treadmill.

DETAILED DESCRIPTION OF THE INVENTION

The invention will now be more clearly understood from the following description of some embodiments thereof given by way of example only with reference to the accompanying drawings, in which:—

Figure 18:
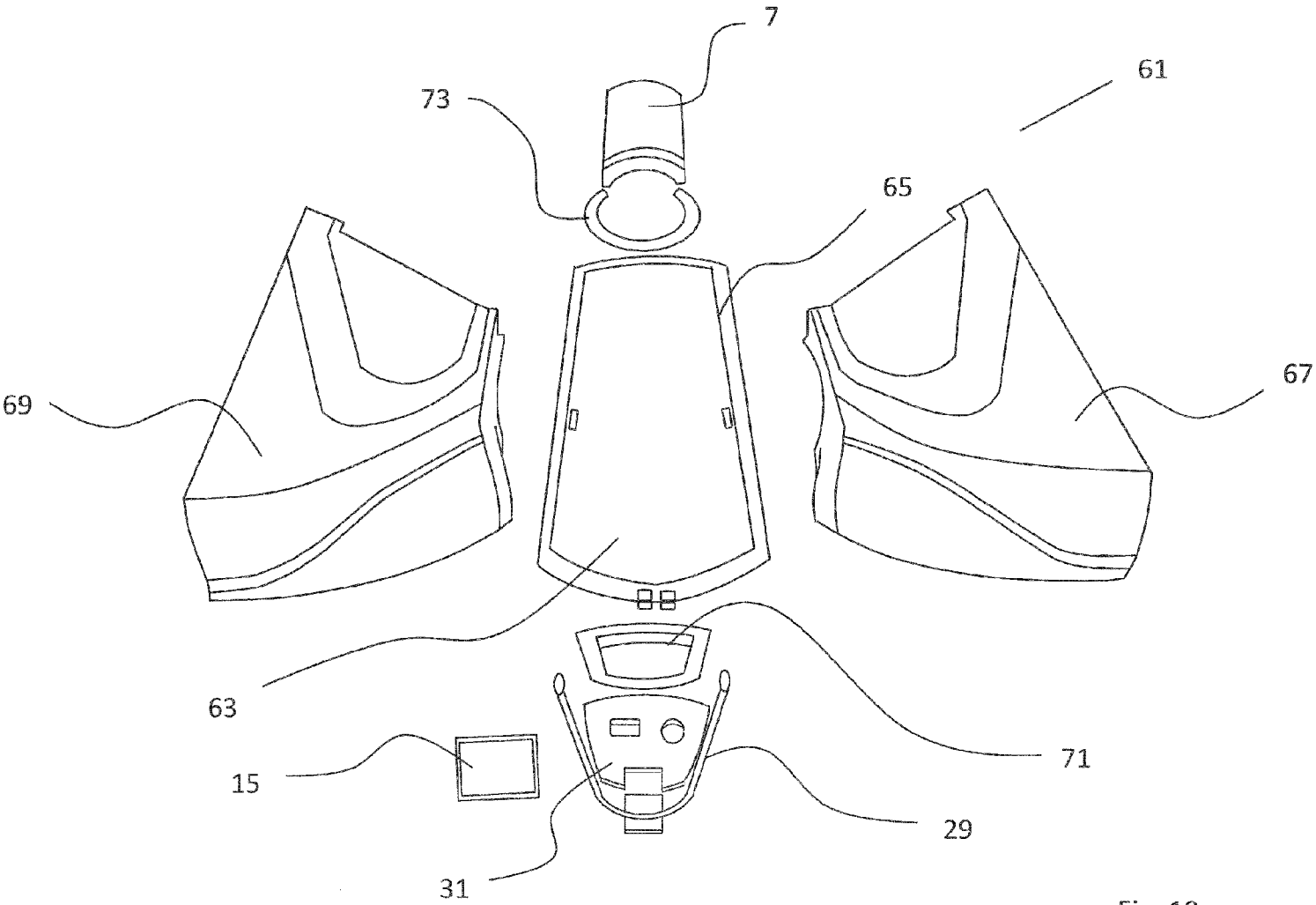
FIG. 18 is an exploded view of a plurality of the components used in the construction of an alternative embodiment of exercise device according to the invention.
Figure 23:
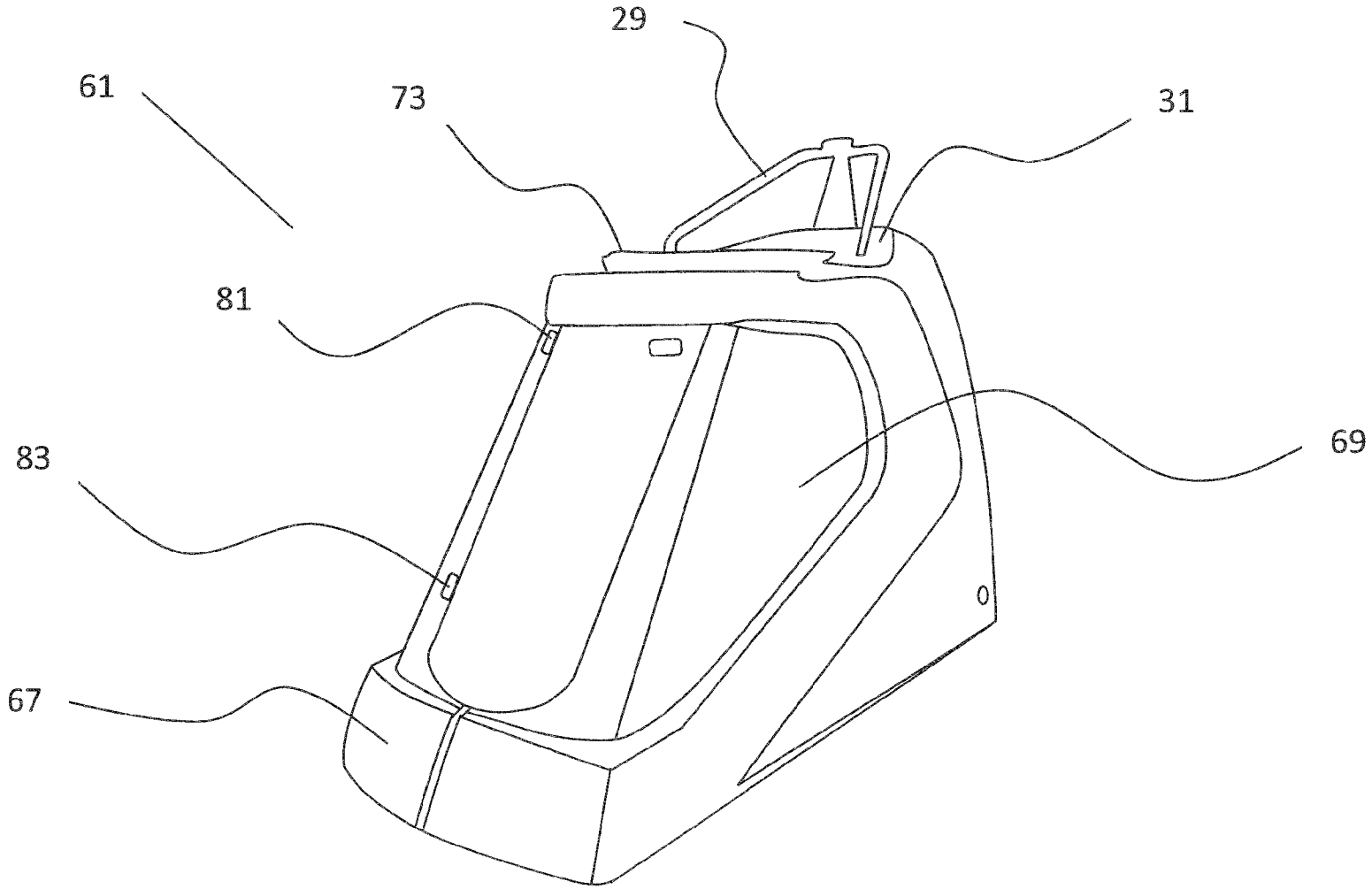
Figure 25:
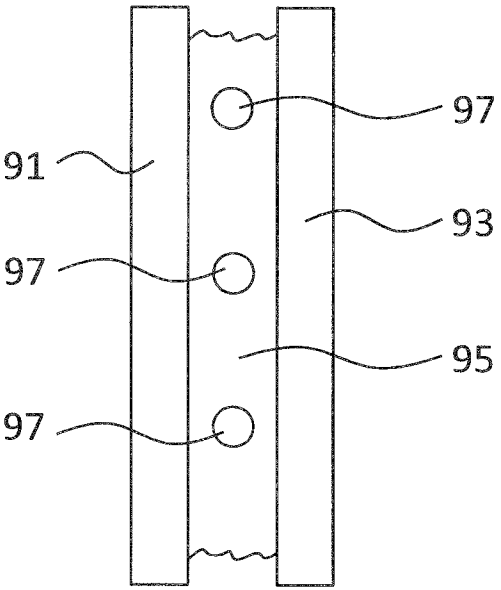
Figure 24:
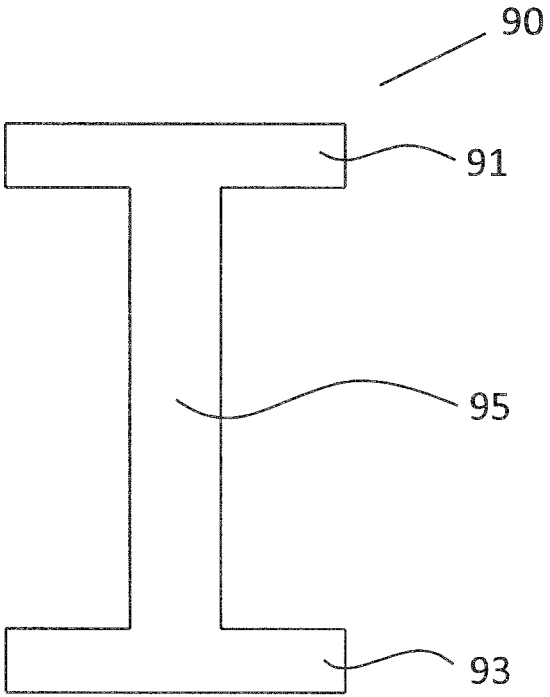

FIGS. 19 to 23 inclusive are views of the exercise device whose components are shown in FIG. 18 in various stages of construction;

FIG. 24 is a top view of a H-seal used in the exercise device according to the present invention; and FIG. 25 is a partial side view of a section of the H-seal shown in FIG. 23.

Referring to FIGS. 1 to 13 inclusive, there is shown an exercise device, indicated generally by the reference numeral 1, comprising a casing 3 defining an exercise chamber 5 and having an opening for accommodating the torso of a user. A door 7 provides access to and from the exercise chamber. The exercise device 1 further comprises an exercise unit 9, in this case a treadmill, located in the exercise chamber, and a vacuum pump 11 operable to create a negative pressure in the exercise chamber 5. There is further provided a control means 13 for controlling the exercise unit 9 and the vacuum pump 11. The control means 13 in turn comprises a control panel 15, an electronics panel 17 mounted in a separate enclosure 19 and a second electronics panel (not shown) mounted internal the exercise unit 9.

The exercise device 1 is provided in a modular construction format having a plurality of components connectable together to form the exercise device 1. For example, referring specifically to FIG. 13, it can be seen that the casing 3 effectively comprises a three part construction including a left hand side casing panel 21, a right hand side casing panel 23 and the door 7 that may be connected together on site to construct the exercise device. The exercise device 1 comprises a base plate 25 upon which the exercise unit 9 and the casing 3 is mounted. The base plate 25 has a peripheral lip 27 extending around the entire periphery of the base plate which forms an air tight seal with the casing side panels 21, 23 when the components are connected together.

In transit, the exercise device will be provided in four or more pieces, one of which being the left hand side panel 21, another of which being the right hand side panel 23 and a third of which being the base plate 25 with or without the exercise unit 9 connected thereto. The door 7, the control panel 15, the electronics panel 17, a user handle 29 and a drinks tray 31 could be provided individually or some/all of these components could be provided already affixed to one of the side panels 21, 23. Once the exercise device 1 arrives at the premises where it is to be installed, all of the pieces 7, 9, 15, 17, 21, 23, 25, 29 and 31 can be brought to the room where the machine is to be located, unpacked from their packaging and then constructed together on site.

Figure 11:
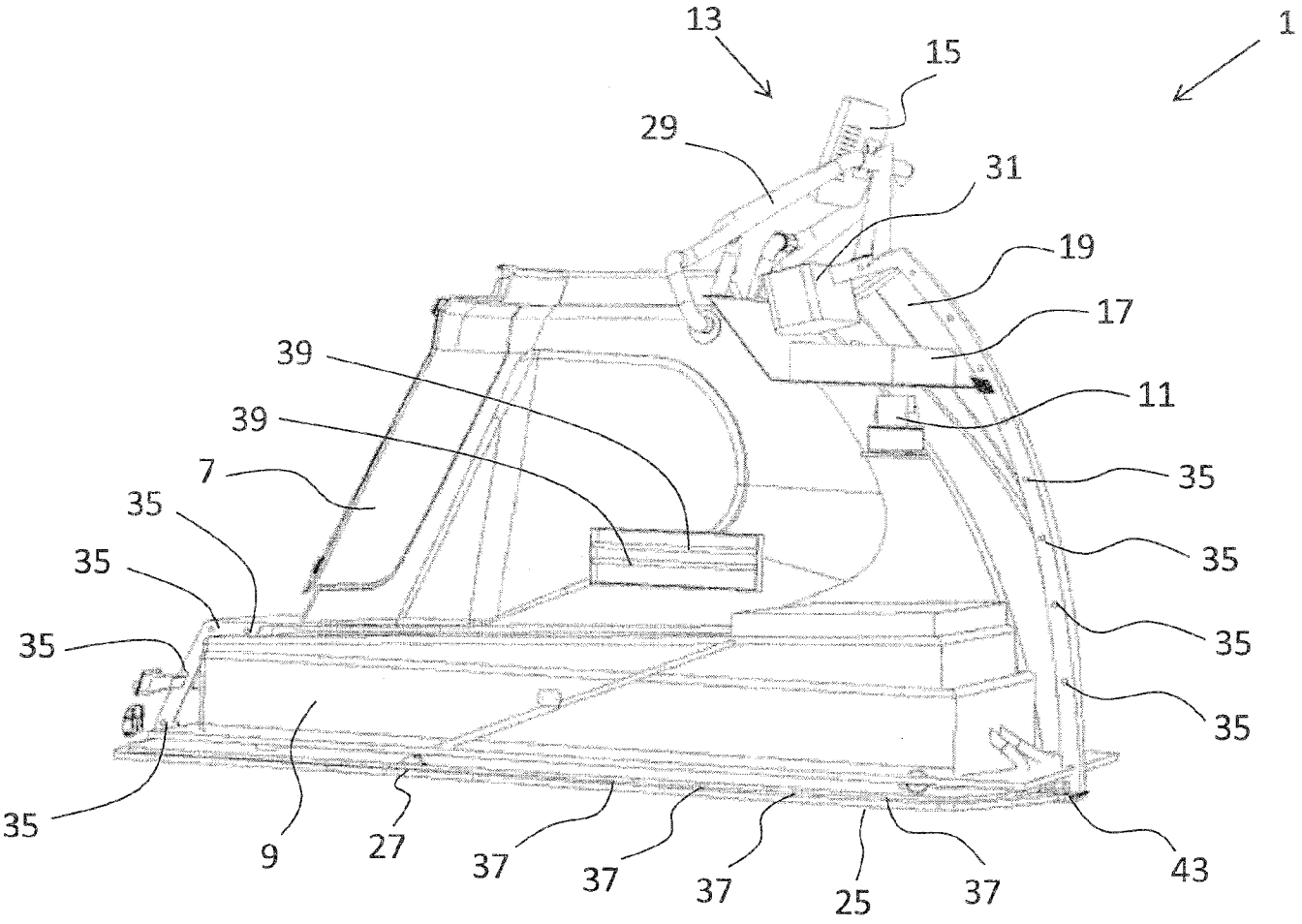
FIG. 11 is a right hand side perspective view of the exercise device with a casing panel removed.
Figure 12:
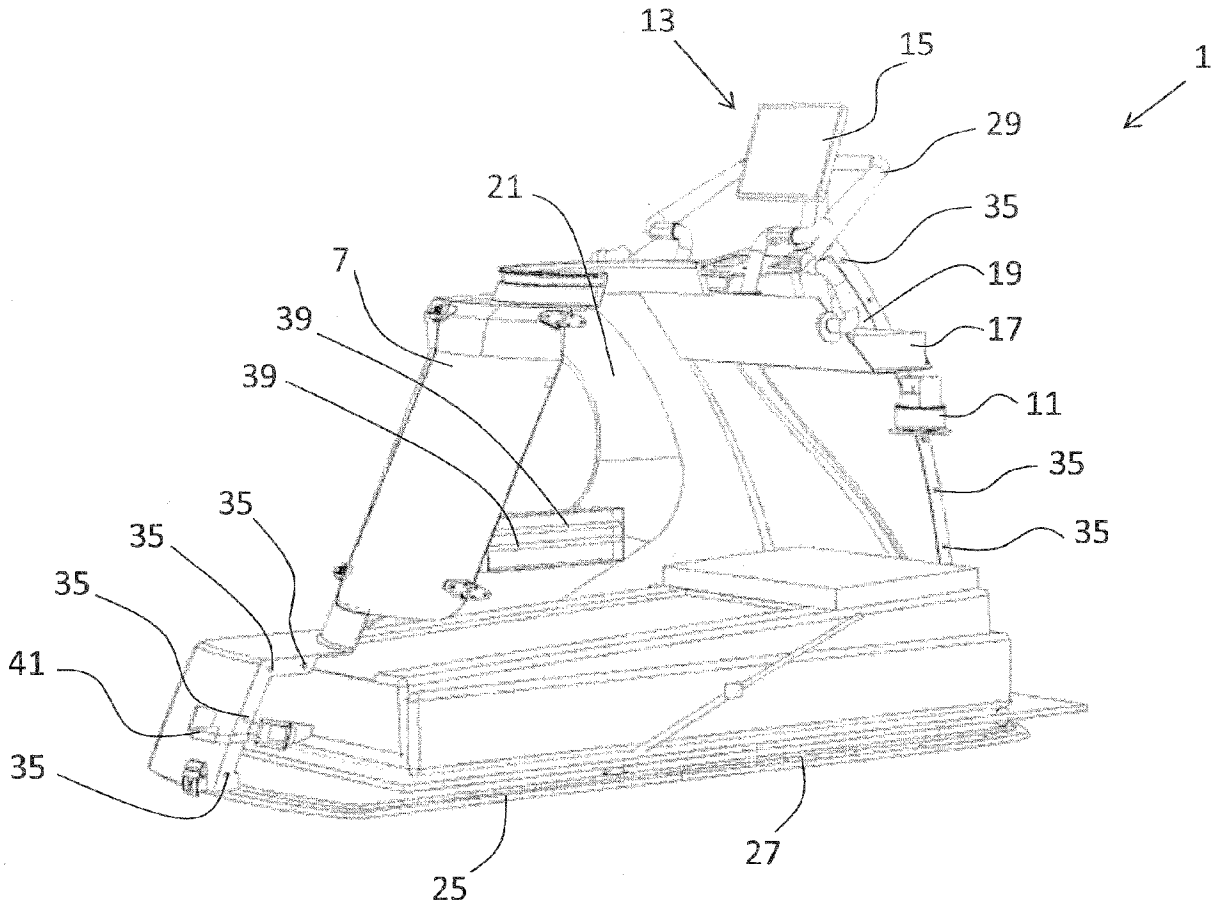
FIG. 12 is a rear perspective view of the exercise device shown in FIG. 11.
Figure 13:
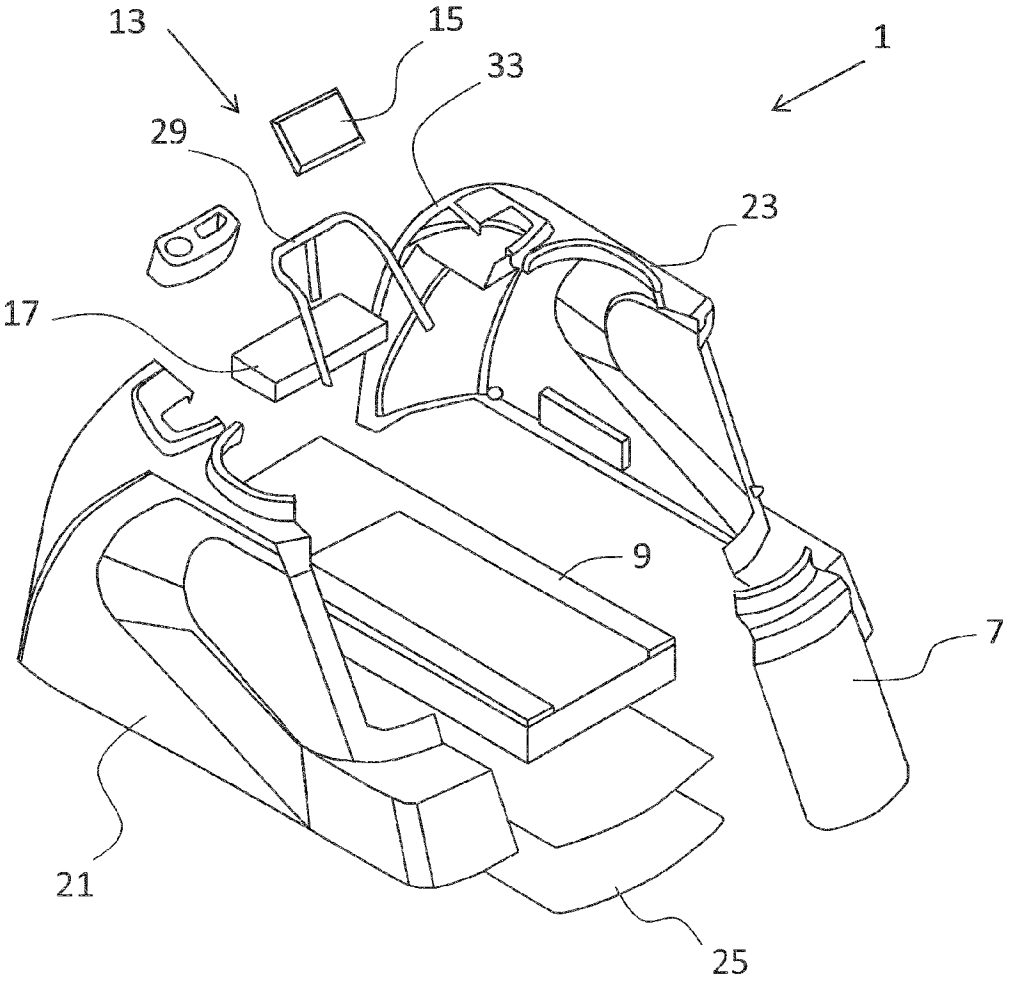
FIG. 13 is an exploded view of the exercise device according to the invention.
Figure 15:
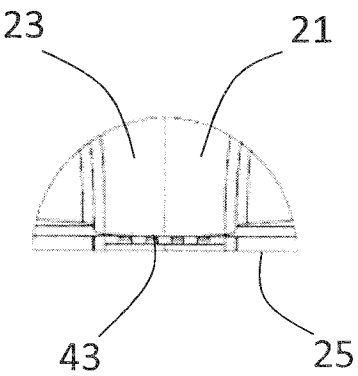
FIG. 15 is an enlarged view of the circled portion marked "A" in FIG. 14.
Figure 14:
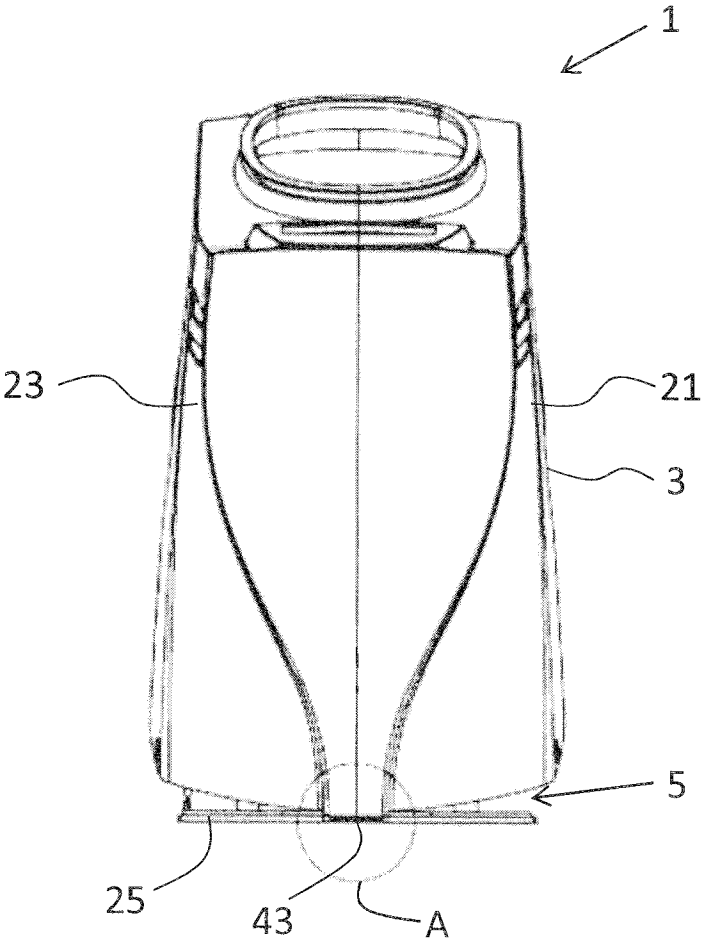
FIG. 14 is a front view of the casing with the control equipment removed for clarity showing the casing pivoted about a hinge on the base plate.
Figure 16:
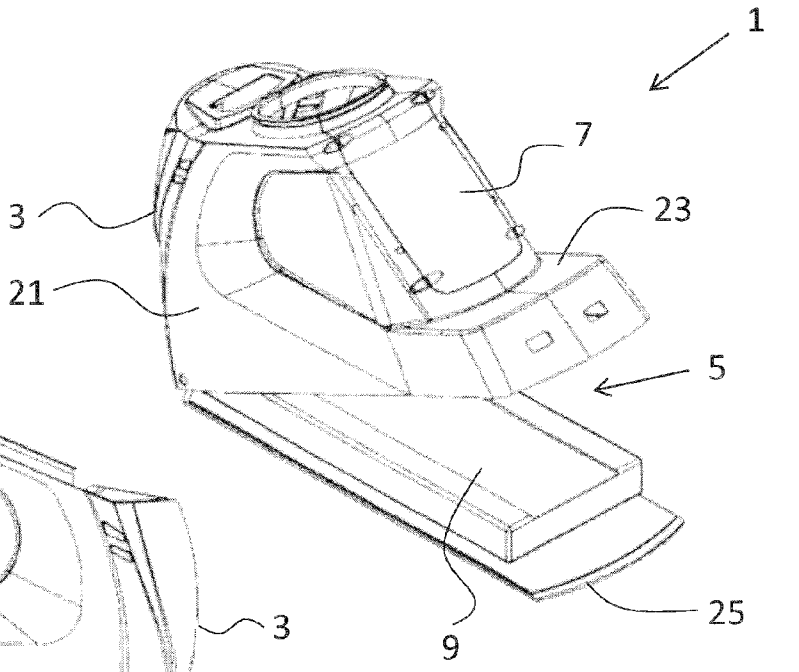
FIG. 16 is a rear perspective view of the exercise device shown in FIG. 14.

The connection members between the side panel 21 and the side panel 23 are of a relatively simple construction to allow fast and efficient construction of the exercise device on site. Right hand side panel 23 has a plurality of male members, in this case studs 33 (as best illustrated in FIGS. 3 to 8 inclusive) that are received in complementary female members, in this case recesses 35, in the left hand side panel 21 (as best illustrated in FIGS. 11 and 12). The studs 33 form a push fit in the recesses 35 and there will preferably be provided a seal, for example a rubber seal between the two side panels 21, 23 to form an air tight seal between the two side panels 21, 23.

The base plate 25 has a plurality of recesses 37 spaced about the peripheral lip 27 for reception of studs (not shown) on the underside of the side panels 21, 23. Again, a rubber seal (not shown) will preferably be provided between the side panels 21, 23 and the peripheral lip 27 to provide an air tight seal therebetween. It is envisaged that the studs on the underside of the side panels 21, 23 will form a relatively loose fit in the recesses 37 to allow relative movement therebetween.

In one embodiment, the studs 33 will each have an enlarged head portion (not shown) that is received in an enlarged cavity (not shown) in the recess 35. Either the enlarged heads or the entrance to the enlarged cavity will preferably be constructed from a resilient material to allow the studs "click" into place and to allow entry of the enlarged head into the enlarged cavity but prevent easy withdrawal of the enlarged head from the enlarged cavity. This will help to securely locate the studs 33 in the recesses 35. Alternatively, a screw thread may be provided on one or more of the studs 33 for engagement of a complementary screw thread on the recess 35. Furthermore, other securing means such as but not limited to an over-centre clasp could be used to bring the two side panels 21, 23 into close contact and a fixed relationship with respect to each other.

There is further provided a plurality of infra-red bulbs 39 mounted on the interior of the casing 3 on each of the side panels 21, 23. The is also provided a handle 41 that may be used to raise and lower the casing 3 as will be described in greater detail below with reference to FIGS. 14 to 17.

Figure 1:
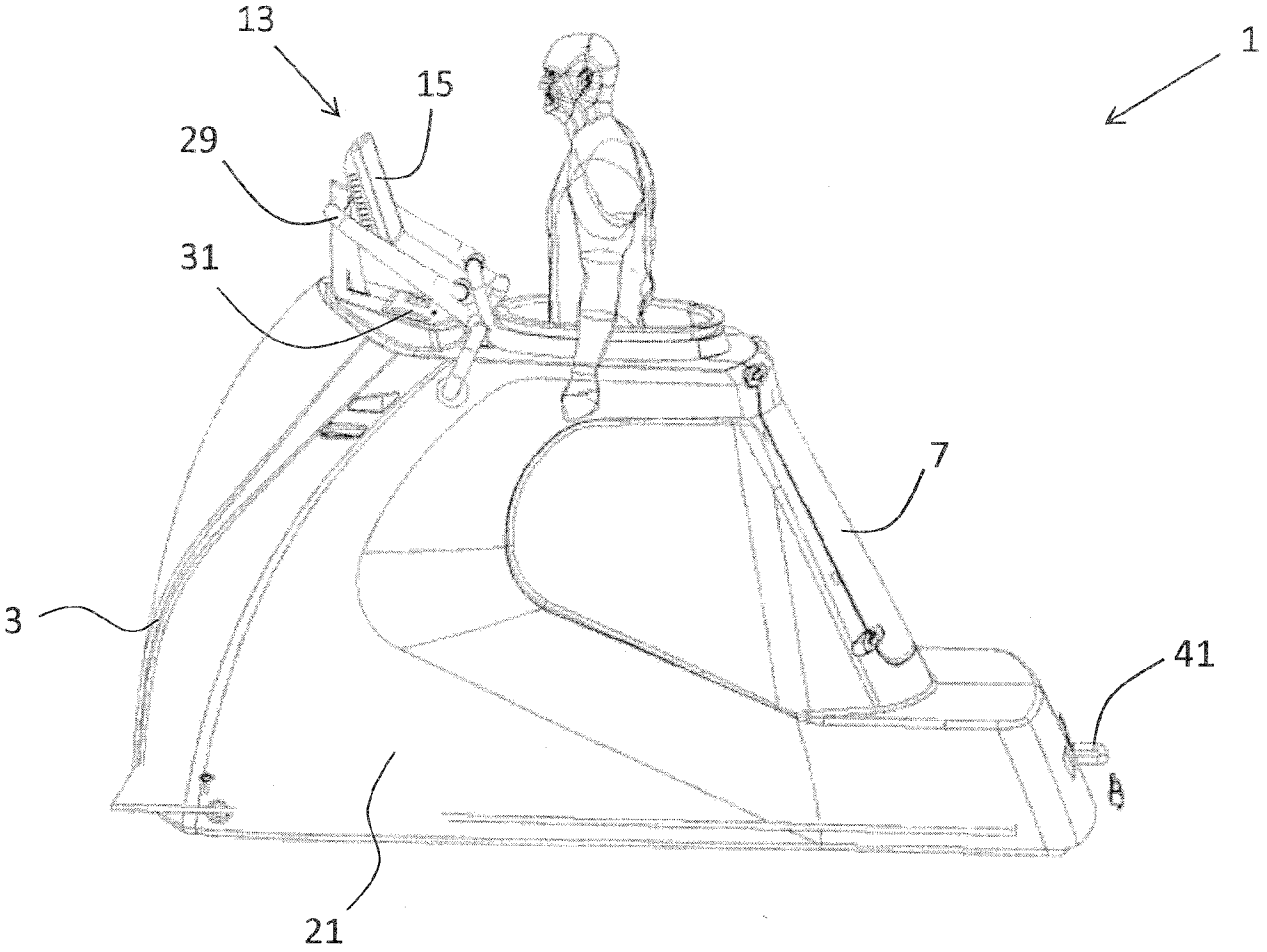
FIG. 1 is a perspective view of an exercise device according to the invention.
Figure 2:
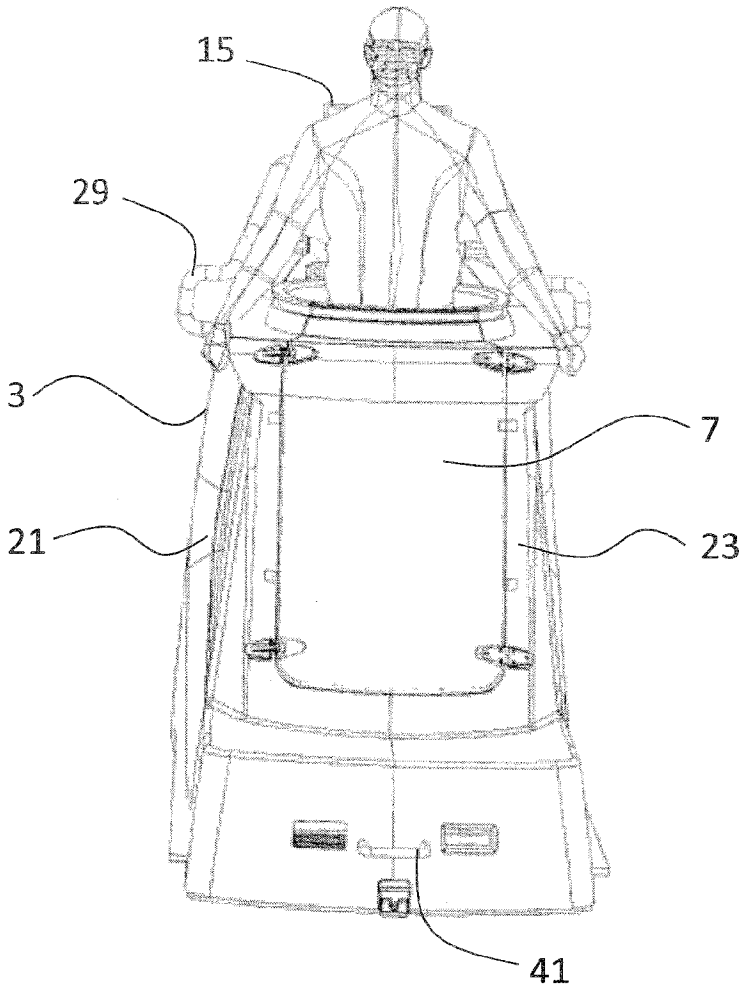
FIG. 2 is a rear view of the exercise device shown in FIG. 1.
Figure 3:
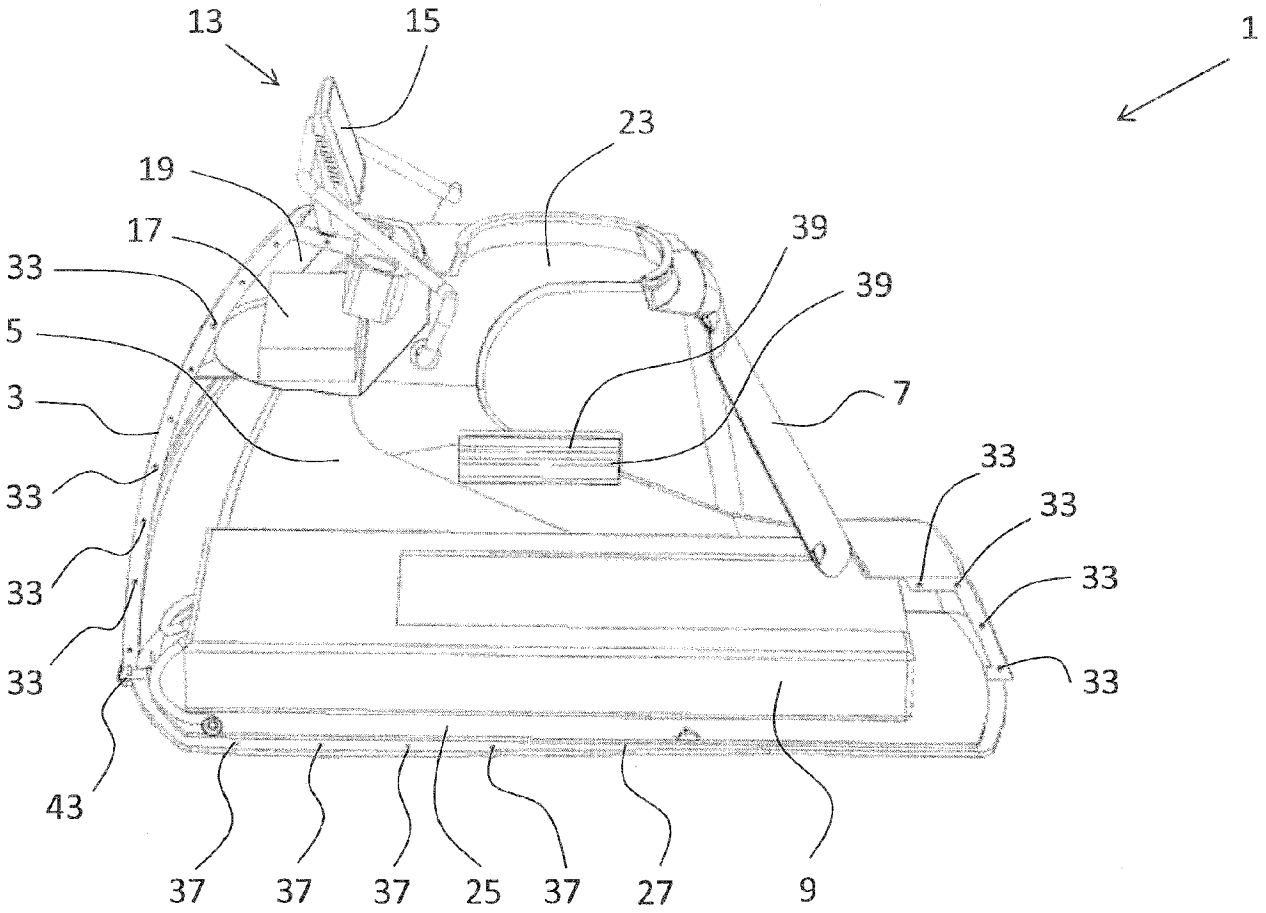
FIG. 3 is a left hand side perspective view of the exercise device with a casing panel removed.
Figure 4:
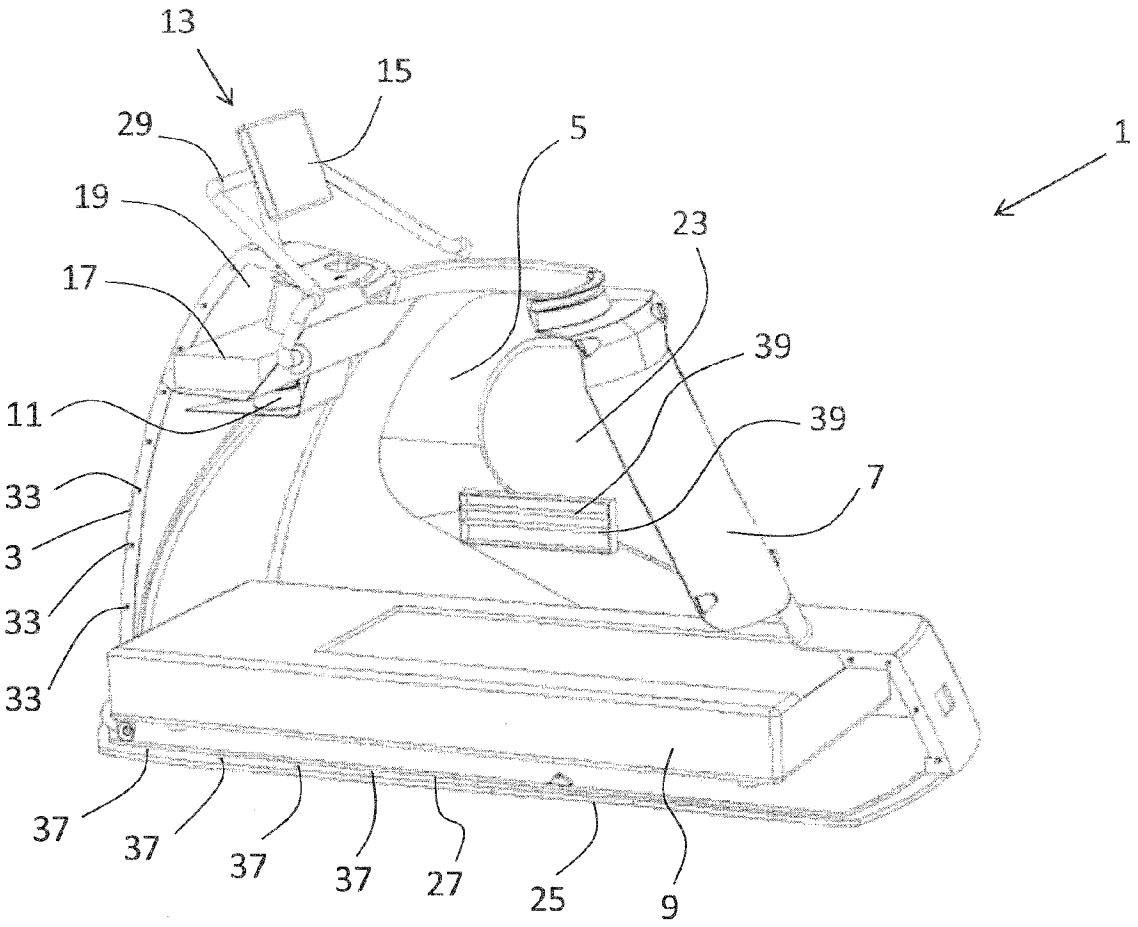
FIG. 4 is a rear perspective view of the exercise device shown in FIG. 3.
Figure 5:
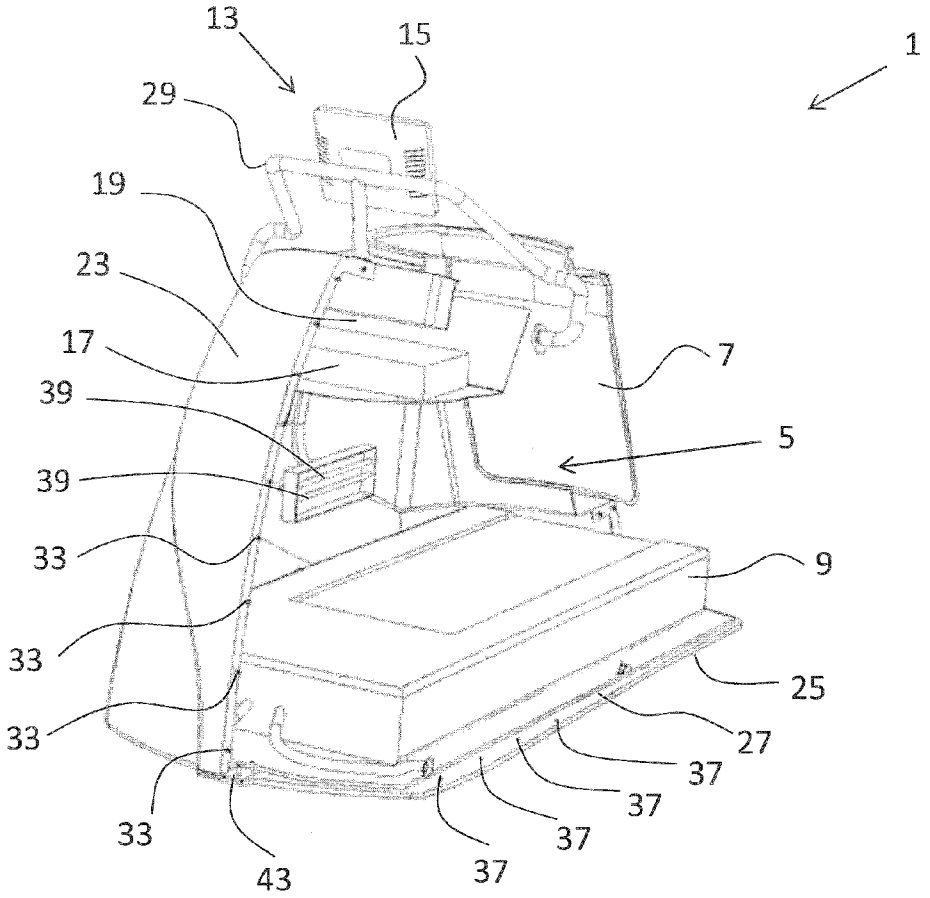
FIG. 5 is a front perspective view of the exercise device shown in FIG. 3.
Figure 6:
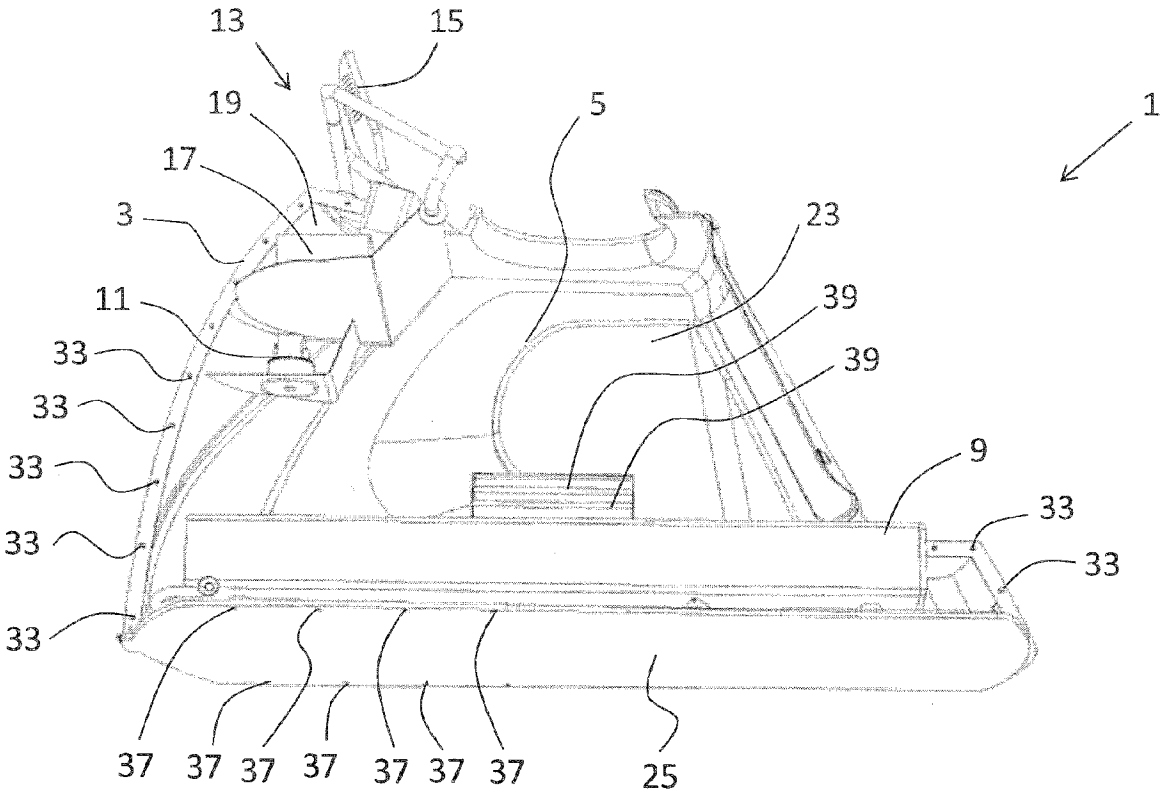
FIG. 6 is a side perspective view shown from below of the exercise device shown in FIG. 3.
Figure 7:
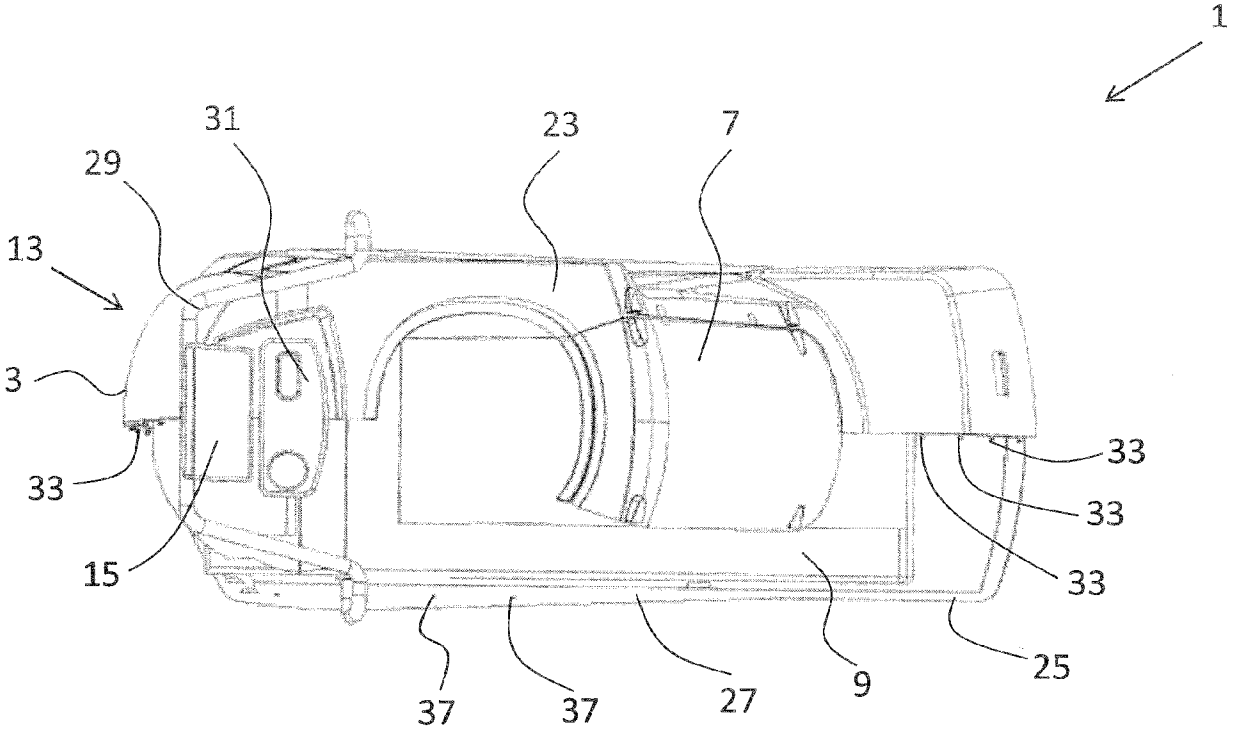
FIG. 7 is a top plan view of the exercise device shown in FIG. 3.
Figure 8:
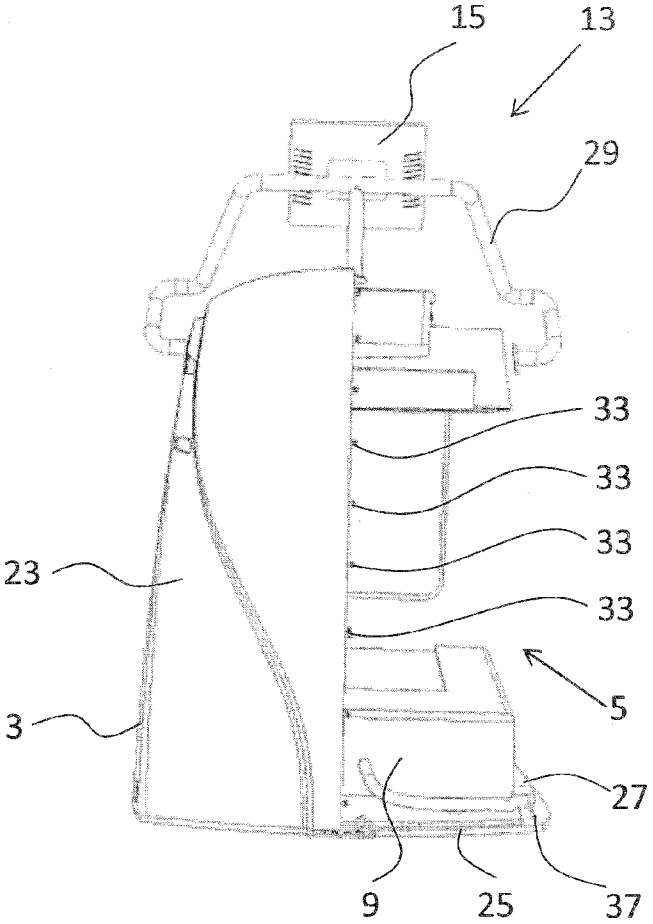
FIG. 8 is front view of the exercise device shown in FIG. 3.
Figure 9:
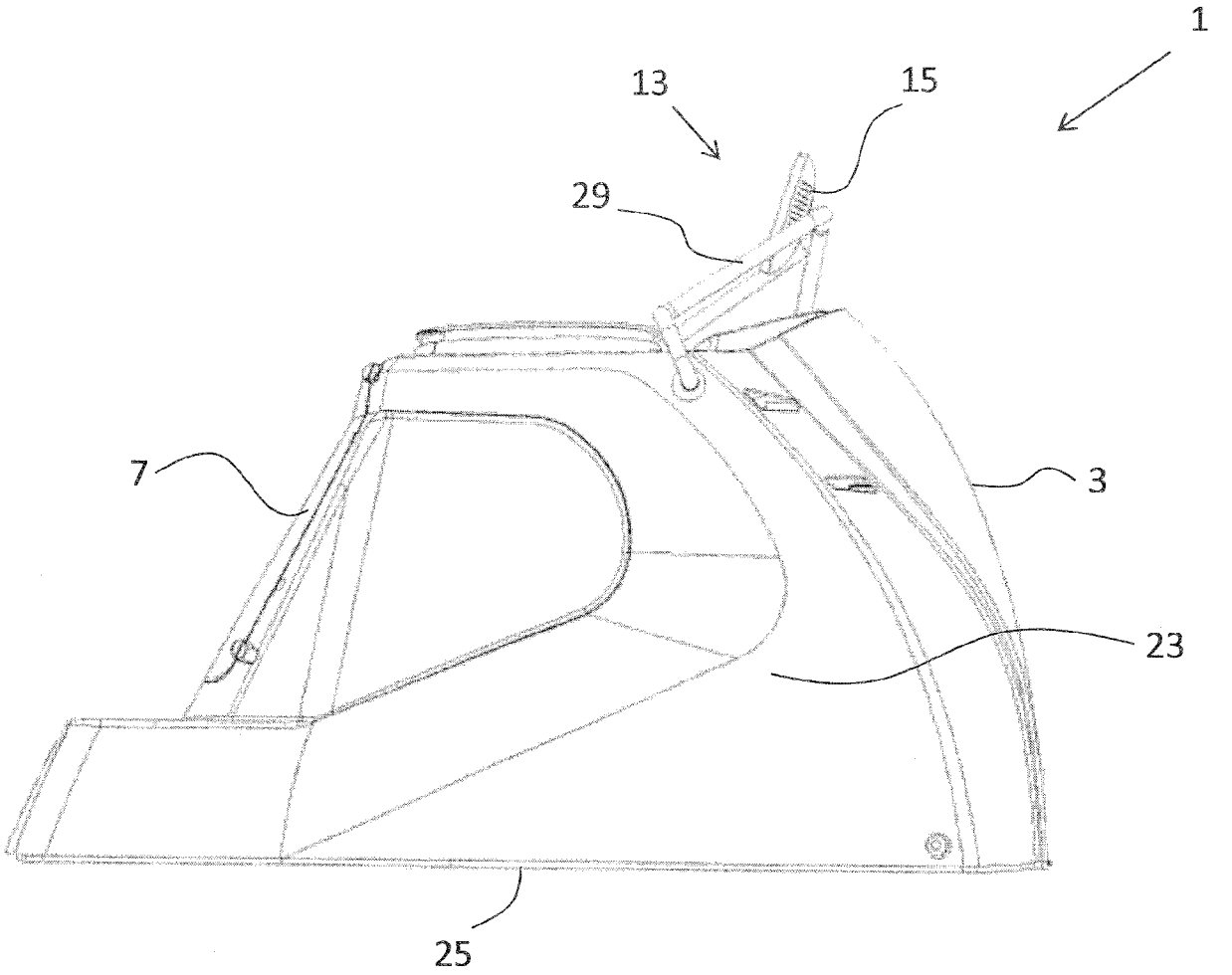
FIG. 9 is a right hand side view of the exercise device shown in FIG. 3.
Figure 10:
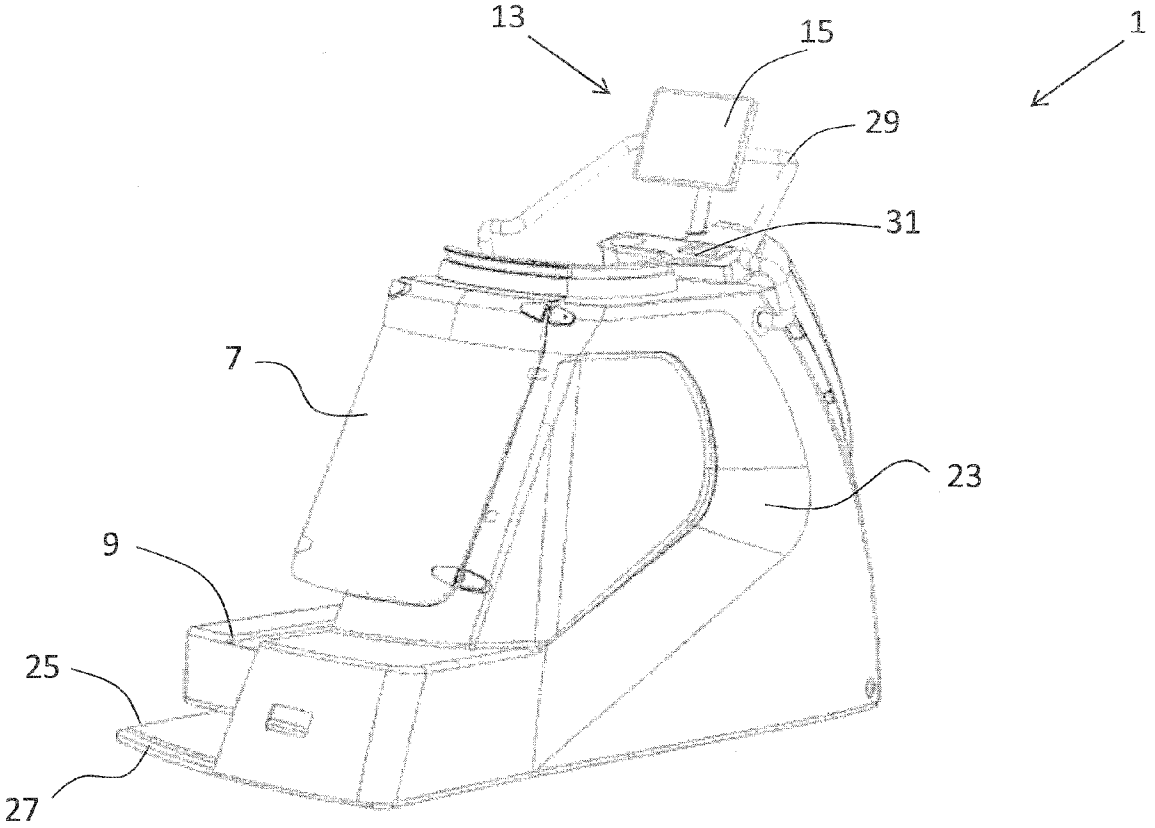
FIG. 10 is rear perspective view of the exercise device shown in FIG. 3.
Figure 17:
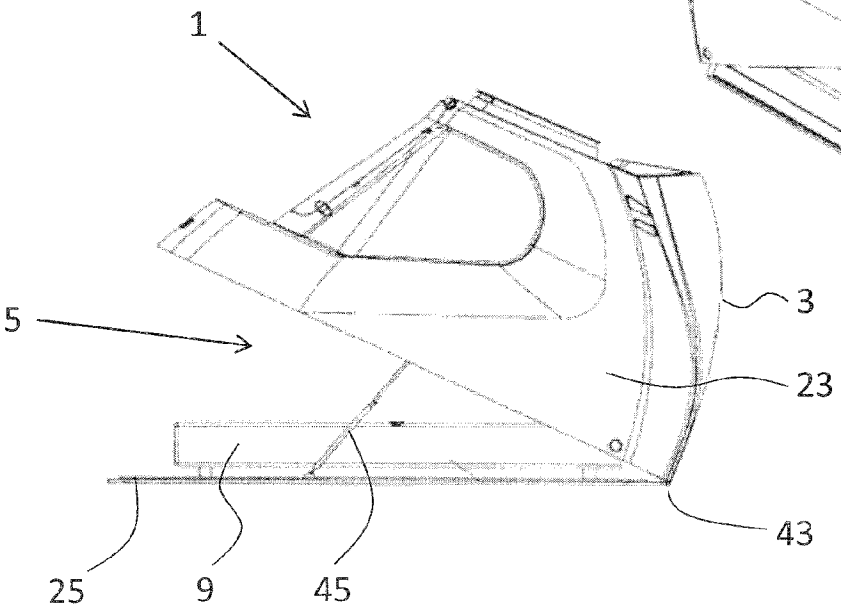
FIG. 17 is a side view of the exercise device shown in FIG. 14.

Referring now to FIGS. 14 to 17 inclusive, there is shown a plurality of views of the casing 3 pivoting about the base plate 25. The casing 3 is connected to the base plate 25 by way of a hinge joint 43. The hinge joint 43 allows the casing 3 to pivot about the hinge joint to and from a raised position free of the base plate 27 (FIGS. 16, 17) and a lowered position in abutment with the base plate 27 (FIGS. 1, 2). A gas strut 45 is provided, as shown in FIG. 17, to allow the casing 3 to be temporarily held in a raised position free of the base plate 27. This arrangement will allow simple access to the interior of the exercise device 1 which will facilitate cleaning and repair.

Referring to FIGS. 18 to 22, there is shown an alternative construction of exercise device according to the present invention, where like parts have been given the same reference numerals as before. The exercise device, indicated generally by the reference numeral 61, is more compact in a fore and aft direction than the exercise device illustrated in FIGS. 1 to 17 inclusive and does not have a step rearward of the door 7. Referring specifically to FIG. 18, there is shown in exploded view, many of the components used in the construction of the exercise device 61. For reasons of clarity, the treadmill, the vacuum pump, the power cables, the control electronics and the control cables have been omitted from the drawings however their positioning will be evident from the following description and also from the foregoing discussion. The exercise device 61 comprises a base plate 63 having a peripheral lip 27 and a groove 65 formed in the peripheral lip 27. The groove 65 is dimensioned to receive the lowermost edge of each of the left and right side casing panels. The exercise device 61 further comprises a left side casing panel 67, a right side casing panel 69, a door 7, a control panel 15, a separate enclosure for the electronics panel (not shown), provided by way of bowl shaped receptacle 71, a user handle frame 29 and a drinks tray 31. The exercise device 61 further comprises a horseshoe-shaped, opening-defining bracket 73.

Figure 19:
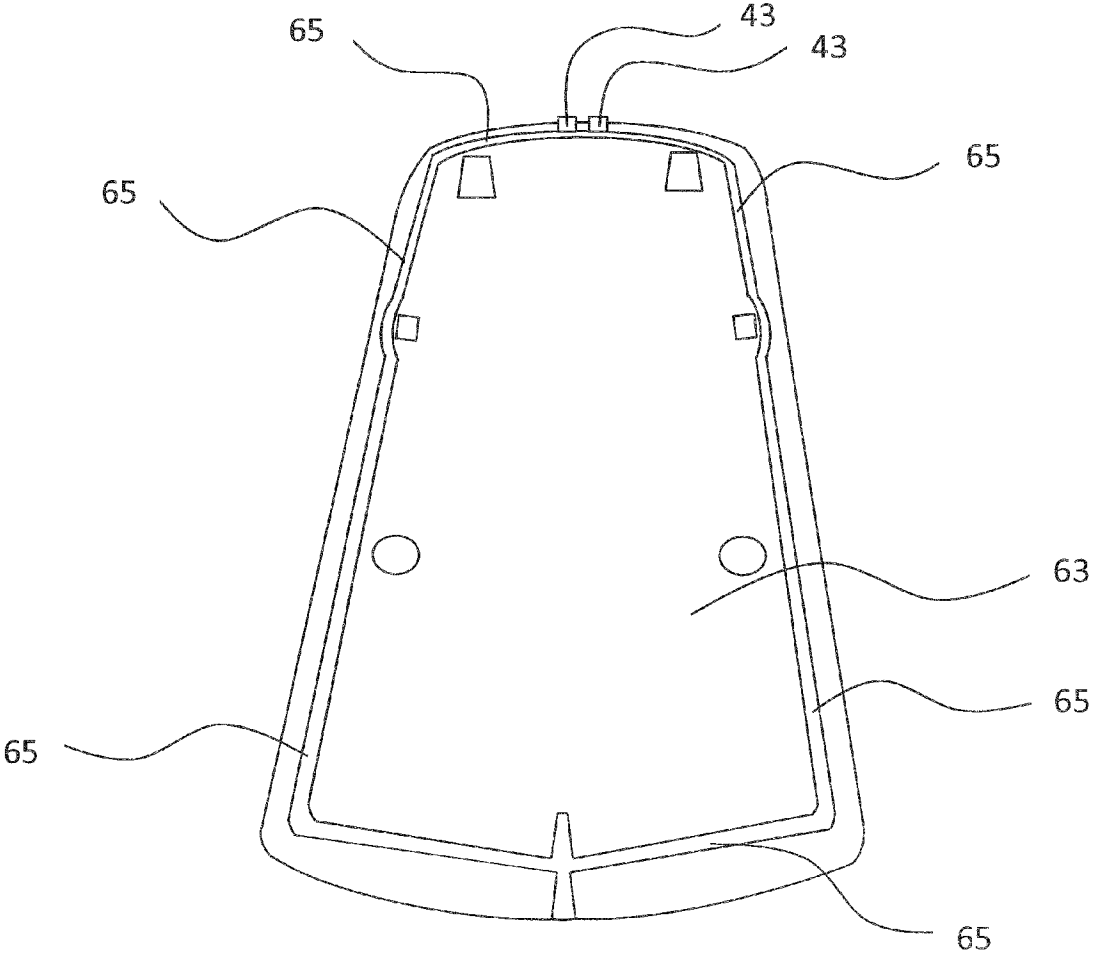
Figure 20:
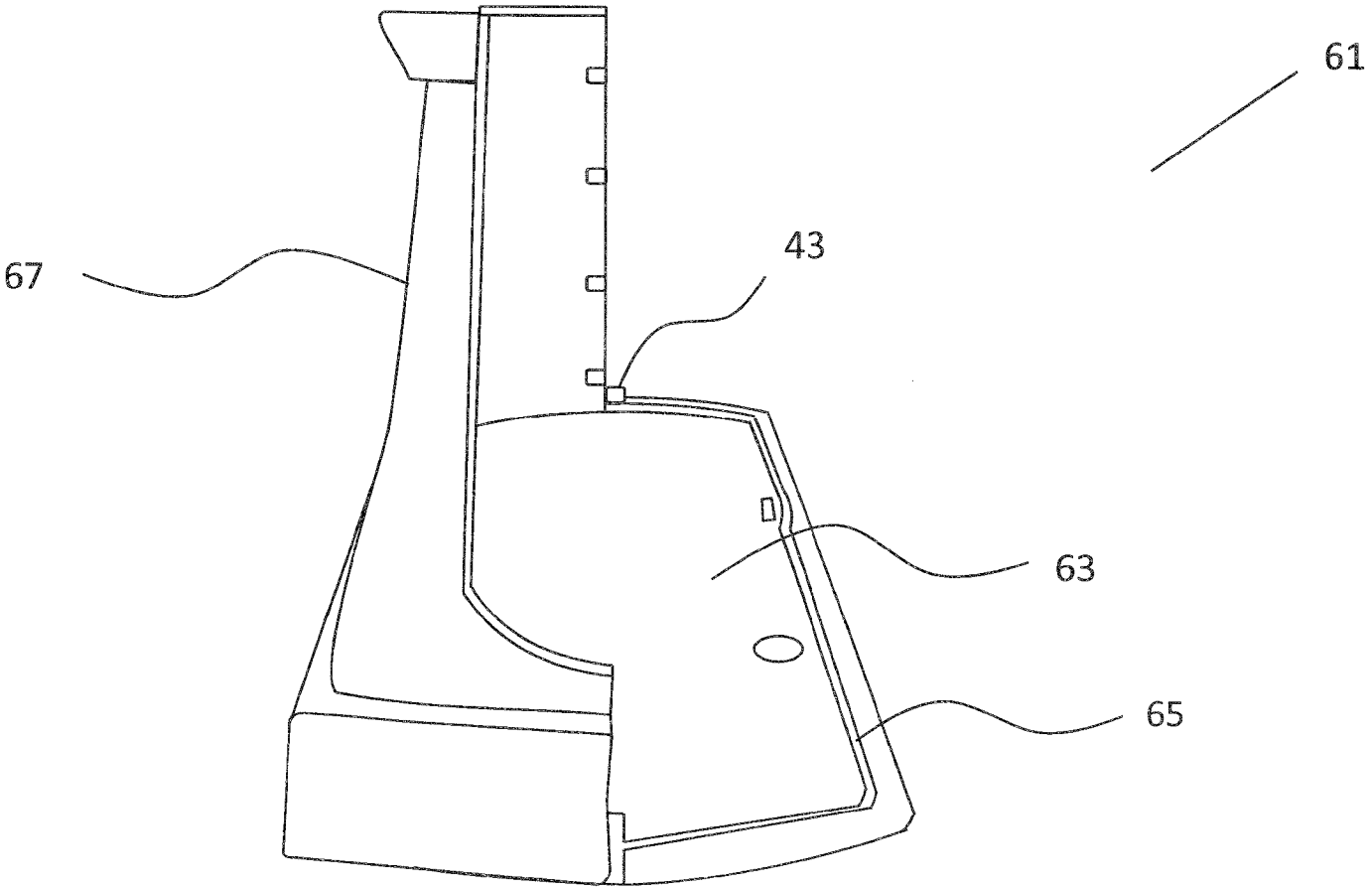
Figure 21:
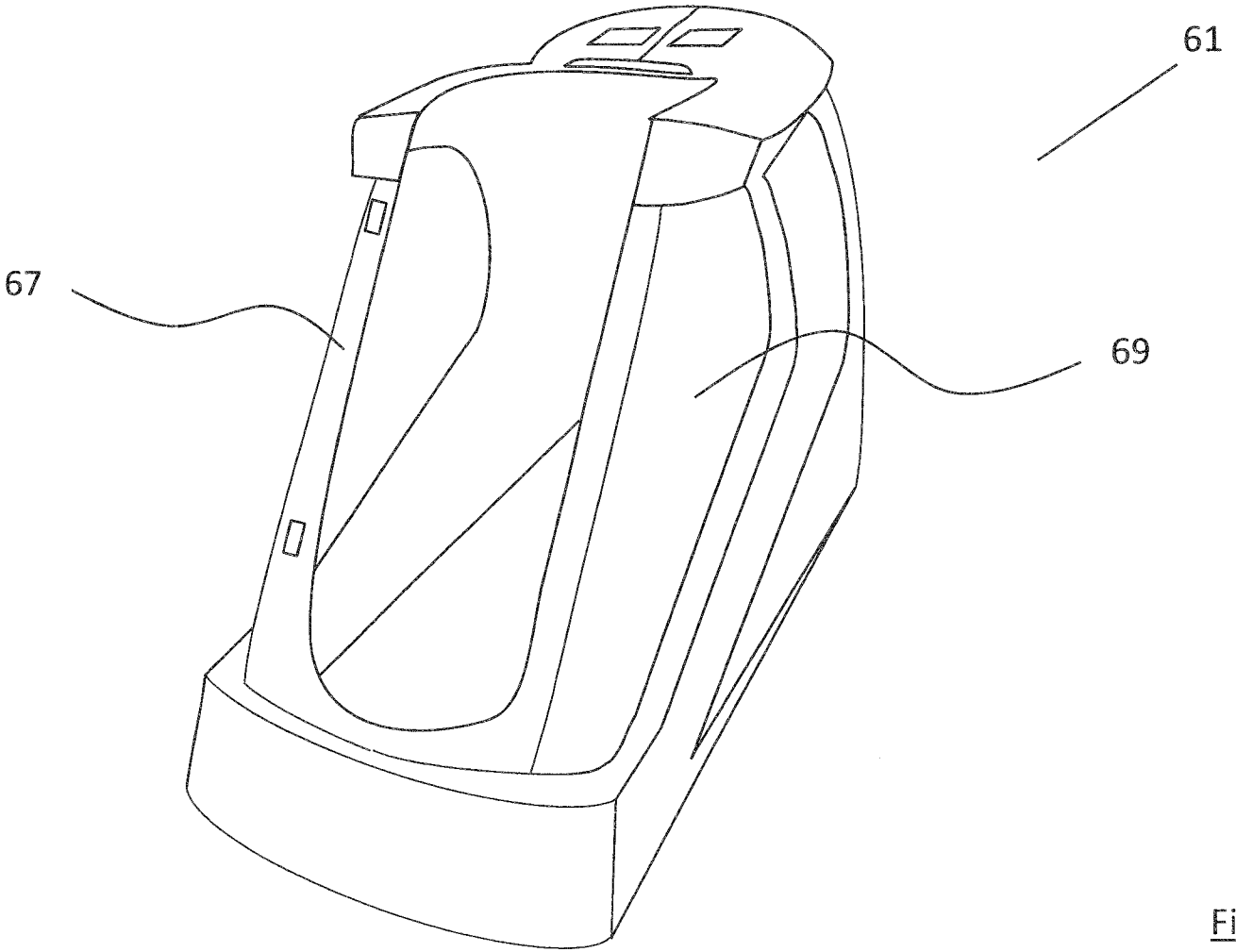

Referring now to FIGS. 19 to 22, in FIG. 19, the base plate 63 is laid out, ready to receive the remaining components. If desired, a rubber seal may be glued in position in the groove 65 of the base plate 63. Alternatively, the rubber seal may be mounted on the lowermost edge of the left side casing panel and the right side casing panel (not shown). In FIG. 20, the left side casing panel 67 is positioned with its lowermost edge in the groove 65 and the left side casing panel is connected to the hinge joint 43. In FIG. 21, the right side casing panel 69 is positioned with its lowermost edge in the groove 65 and the right side casing panel 69 is connected to both the left side casing panel 67 and the hinge joint 43. Before bringing the right side casing panel into engagement with the left side casing panel, a H-seal is placed on one of the left side casing panel 67 and the right side casing panel 69 so that when the right side casing panel 69 and the left side casing panel 67 are brought into engagement with each other, the H-seal is located therebetween.

A number of complementary engagement members will be provided on the left side casing panel and the right side casing panel to connect the left and right side casing panels together. For example, a number of protrusions with enlarged, resiliently deformable heads may be provided on one or both of the left side casing panel and the right side casing panel for engagement of a corresponding aperture on the other of the left side casing panel 67 and the right side casing panel 69.

Figure 22:
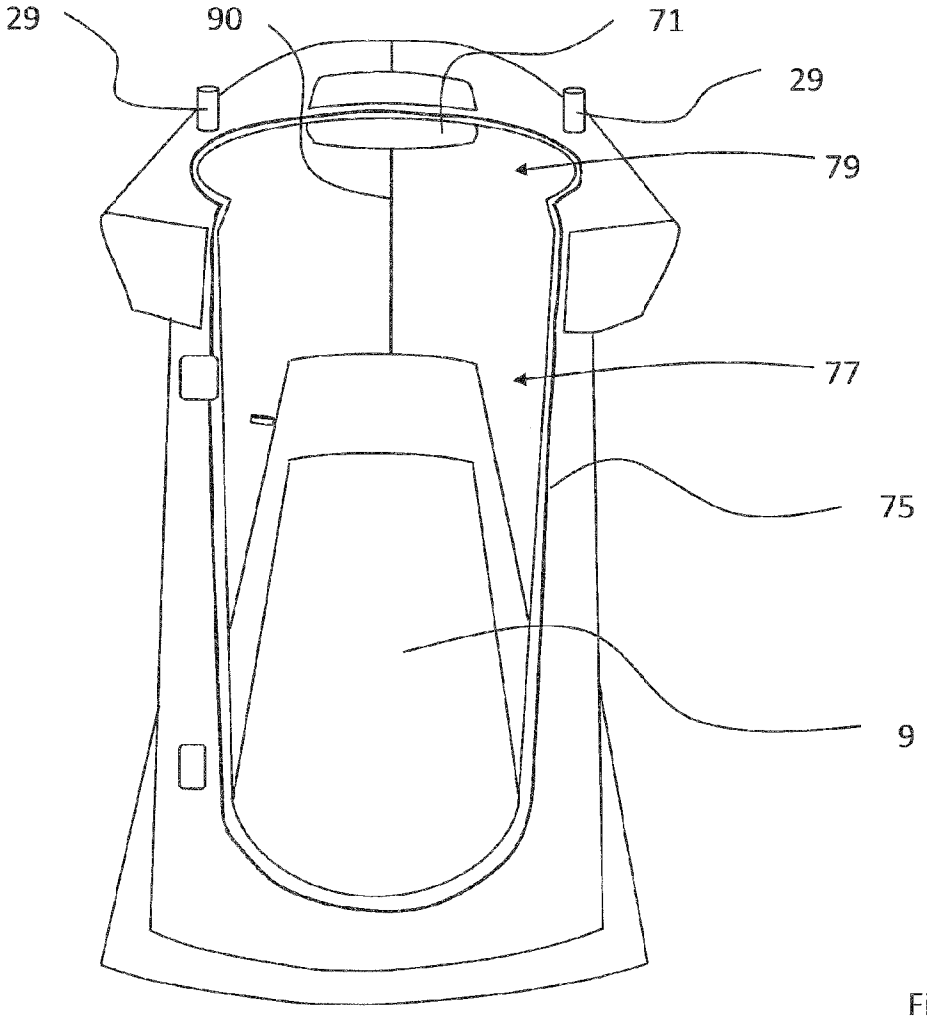

Referring to FIG. 22, the treadmill 9 is positioned inside the casing chamber. This is achieved by pivoting the left side casing panel and the right side casing panel about the hinge joint 43 so that there is a gap between the casing panels and the base through which the treadmill may be inserted, preferably by rolling the treadmill (if the treadmill is provided with wheels). A seal 75 is then mounted on the left side casing panel and right side casing panel surrounding the aperture 77 where the door 7 will be fitted and also surrounding the opening 79 for the user's torso. The separate enclosure 71 for the electronics and the user handle frame 29, only parts of which are shown, are mounted on the casing and are secured in place, preferably with nuts and bolts (not shown). The separate enclosure 71 and the user handle frame 29 will act as bracing struts holding the two side casing panels 67, 69 in engagement with each other. The electronics panel (not shown) is mounted in the separate enclosure 71. Wiring to and from the electronics panel, the vacuum pump (not shown), the control panel (not shown) and the treadmill 9 is provided. A part of the H-seal 90 is visible in FIG. 22.

A ventilation pipe (not shown) between the interior of the separate enclosure 71 for the electronics panel and the exterior of the exercise device 61 through one of the side casing panels 67, 69 is installed. A second ventilation pipe (not shown) between a second electronics panel (not shown) in a separate enclosure (not shown) of the treadmill 9 and the exterior of the exercise device 61 through one of the side casing panels 67, 69 is also installed. It will be understood that suitable apertures will be provided in the side casing panel and each of the enclosures for connection to either end of each of the ventilation pipes.

In FIG. 23, the horseshoe-shaped, opening-defining bracket 73 and the drinks tray 31 are mounted on the left side casing member 67 and the right side casing member 69. Similar to the user handle frame 29 and the separate enclosure 71, both the horseshoe-shaped, opening-defining bracket 73 and the drinks tray 31 will act as bracing struts holding the left side casing member 67 in engagement with the right side casing member 69. The door 7 is then mounted on the left side casing member 67 about hinges 81, 83. Finally, the power and control wiring to the treadmill 9, the vacuum pump (not shown), the electronics panel (not shown) and the control panel (not shown) are then connected up.

Referring to FIGS. 24 and 25, there are shown some diagrammatic representations of the H-seal 90 for connection intermediate the pair of side casing panels. The H-seal 90 comprises a pair of lateral cross-members 91, 93 bridged by a central interconnector 95. Referring specifically to FIG. 25, it can be seen that the central interconnector 95 is provided with a plurality of throughholes 97 each of which is dimensioned to allow throughpassage of a resiliently deformable head (not shown) of a protrusion of a complementary engagement member. In this way, the H-seal can be placed on the side casing panel and retained in position while the side casing panels are brought into engagement with each other.

It will be understood that various constructions and materials could be used for the casing in particular however it is envisaged that fiberglass or a plastics material would be particularly suitable for the casing. Furthermore, the precision of vacuum fusion moulding is seen as a particularly suitable manufacturing methodology to use as the tolerances can be kept to a very tight margin even for such a relatively large device. In the embodiments shown, the exercise device comprises a treadmill. However, it will be understood that the present invention is in no way limited solely to use with a treadmill. It is envisaged that other types of exercise devices including but not limited to steppers, cross-trainers, stationary exercise bicycles and the like could be used to equal effect. Furthermore, it is envisaged that a neoprene skirt could be used to provide the seal between the persons torso and the opening to ensure that the desired negative pressure is maintained inside the chamber. However, other seals such as rubber skirts or the like could be provided instead.

In this specification the terms "comprise, comprises, comprised and comprising" and the terms "include, includes, included and including" are all deemed totally interchangeable and should be afforded the widest possible interpretation. The invention is in no way limited to the embodiment hereinbefore described but may be varied in both construction and detail within the scope of the claims.

The invention claimed is:

1. An exercise device comprising a casing defining an exercise chamber having an opening to receive a torso of an individual during use of the exercise device, a door in the casing to provide access to and from the exercise chamber, an exercise unit located in the exercise chamber, a vacuum pump operable to create a negative pressure in the exercise chamber and a control means for controlling the exercise unit and the vacuum pump, in which the exercise device is provided in a modular construction format having a plurality of separate components connectable together on site to form the exercise device, the components including at least a separate planar base plate suitable for reception of the exercise device thereon and in which, in addition to the door that provides access into the chamber, the casing comprises a two-part casing divided along the longitudinal axis of the casing and along a vertical plane into two substantially equally-dimensioned opposite parts including a left side casing panel and a right side casing panel, the left side casing panel and the right side casing panel each having complementary engagement members for engagement of the other of the left side casing panel and the right side casing panel, and in which there is provided a hinge joint mounted on the base plate for engagement of at least one of the left side casing panel and the right side casing panel and to permit pivoting of the connected left side casing panel and right side casing panels in unison about the hinge joint to and from a lowered position in which the left side casing panel and the right side casing panel are in sealed engagement with the base plate and a raised position in which the left side casing panel and the right side casing panel are inclined with respect to the base plate allowing access to the interior of the chamber between the left side casing panel, the right side casing panel and the base plate.

2. The exercise device as claimed in claim 1 in which there is provided a rubber seal intermediate the base plate and the left side casing panel and intermediate the base plate and the right side casing panel.

3. The exercise device as claimed in claim 1 in which the base plate comprises a peripheral lip having a channel formed therein for reception of the lowermost edge of both the left side casing panel and the right side casing panel.

4. The exercise device as claimed in claim 1 in which there is provided a seal intermediate the left side casing panel and the right side casing panel.

5. The exercise device as claimed in claim 4 in which the seal intermediate the left side casing panel and the right side casing panel is a H-seal.

6. The exercise device as claimed in claim 4 in which the seal intermediate the left side casing panel and the right side casing panel is provided with a plurality of apertures for reception of one set of the complementary engagement members on one of the left side casing panel and the right side casing panel.

7. The exercise device as claimed in claim 1 in which there is provided a separate horseshoe-shaped, opening-defining bracket for engagement of both the left side casing panel and the right side casing panel and partially surrounding the opening for the torso of the individual.

8. The exercise device as claimed in claim 7 in which the door is provided with an arcuate-shaped, opening-defining bracket which together with the horseshoe-shaped, opening-defining bracket form an annular, opening-defining bracket for reception of a sealing skirt when the door is closed.

9. The exercise device as claimed in claim 1 in which there is provided a unitary handlebar frame that is dimensioned to span across and be connected to both the left side casing panel and the right side casing panel and act as a bracing strut therebetween.

10. The exercise device as claimed in claim 1 in which there is provided a unitary drinks tray that is dimensioned to span across and be connected to both the left side casing panel and the right side casing panel and act as a bracing strut therebetween.

11. The exercise device as claimed in claim 1 in which a separate enclosure for an electronics panel is dimensioned to span across and be connected to both the left side casing panel and the right side casing panel and act as a bracing strut therebetween.

12. The exercise device as claimed in claim 1 in which the plurality of components are releasably connectable together.

13. The exercise device as claimed in claim 1 in which there is further provided a strut internal the casing to releasably maintain the casing in a raised position.

14. The exercise device as claimed in claim 1 in which the hinge joint is located adjacent a forwardmost point on the base plate and in which the hinge joint is connected to both the left side casing panel and the right side casing panel.

15. The exercise device as claimed in claim 1 in which the exercise unit is a treadmill.

16. The exercise device as claimed in claim 2 in which the base plate comprises a peripheral lip having a channel formed therein for reception of the lowermost edge of both the left side casing panel and the right side casing panel.

17. The exercise device as claimed in claim 2 in which there is provided a second seal, the second seal intermediate the left side casing panel and the right side casing panel.

18. The exercise device as claimed in claim 3 in which there is provided a seal intermediate the left side casing panel and the right side casing panel.

19. The exercise device as claimed in claim 5 in which the seal intermediate the left side casing panel and the right side casing panel is provided with a plurality of apertures for reception of one set of the complementary engagement members on one of the left side casing panel and the right side casing panel.

* * * * *